United States Patent [19]

Trefethern et al.

[11] Patent Number: 4,700,648

[45] Date of Patent: Oct. 20, 1987

[54] PROPELLED PONTOON CHAIR

[76] Inventors: George M. Trefethern; Marian J. Trefethern, both of P.O. Box 947, Myrtle Beach, S.C. 29578-0947

[21] Appl. No.: 882,460

[22] Filed: Jul. 8, 1986

Related U.S. Application Data

[63] Continuation of Ser. No. 667,264, Nov. 1, 1984, abandoned, which is a continuation-in-part of Ser. No. 472,142, Mar. 4, 1983, Pat. No. 4,480,568, which is a continuation of Ser. No. 240,777, Mar. 5, 1981, abandoned.

[51] Int. Cl.[4] ..... B63B 1/12; B63H 25/00

[52] U.S. Cl. ..... 114/61; 114/125; 114/144 R; 114/363; 440/62; 440/87

[58] Field of Search ..... 114/61, 124, 125, 144 R, 114/363; 440/6, 7, 62, 87; 441/44–46, 130–132; 244/222, 234; 180/319, 907

[56] References Cited

U.S. PATENT DOCUMENTS

| | | | |
|---|---|---|---|
| 1,082,133 | 12/1913 | Olechnowicz | 114/124 |
| 1,152,654 | 7/1915 | Nosworthy et al. | 114/125 X |
| 2,332,009 | 10/1943 | Perri | 441/130 |
| 3,471,875 | 10/1969 | Lyon | 441/130 |
| 3,517,632 | 6/1970 | Gray | 114/61 |
| 3,580,636 | 5/1971 | Setto | 244/234 X |
| 3,602,181 | 8/1971 | Harris | 440/7 X |
| 3,659,475 | 5/1972 | Nichols | 440/62 X |
| 3,889,625 | 6/1975 | Roller et al. | 440/7 X |
| 4,066,032 | 1/1978 | Travis | 440/6 |
| 4,078,627 | 3/1978 | Brown et al. | 180/907 X |
| 4,143,436 | 3/1979 | Jones | 114/363 |
| 4,311,108 | 1/1982 | Horton | 114/61 |

FOREIGN PATENT DOCUMENTS

| | | | |
|---|---|---|---|
| 705657 | 3/1965 | Canada | 441/130 |

*Primary Examiner*—Sherman D. Basinger

*Attorney, Agent, or Firm*—Oldham, Oldham & Weber Co.

[57] ABSTRACT

A recreational and therapeutic propelled pontoon chair. The invention fundamentally comprises a pair of pontoons in fixed spaced relationship with each other. A chair for maintaining a user is positioned between the pontoons with a drive and power source being maintained behind the chair. The chair is adjustable in elevation and includes an adjustable leg rest. Control cables on an arm rest regulate speed and direction. In another embodiment, such cables are attached to a headband.

15 Claims, 13 Drawing Figures

PROPELLED PONTOON CHAIR

REFERENCE TO RELATED APPLICATION

This is a continuation of co-pending patent application Ser. No. 667,264, filed Nov. 1, 1984, now abandoned, which was a continuation in part of copending patent appli Ser. No. 472.142, filed Mar. 4, 1983, now U.S. Pat. No. 4,480,568, which was a continuation of patent application Ser. No. 240,777, filed Mar. 5, 1981, now abandoned.

TECHNICAL FIELD

This invention herein resides in the art of recreational and therapeutic water vehicles. Particularly, the invention pertains to such a vehicle of the pontoon type.

BACKGROUND ART

The therapeutic effect of water flowing across an individual's flesh has been known for many years. Indeed, the physically handicapped and those suffering from temporary physical disabilities have often been exposed to a turbulent water source to provide a stimulus to affected muscle and circulatory areas. For this purpose, whirlpool baths have been known for many years.

It has further been known that persons with mental or physical disabilities find great satisfaction in being able to control and maneuver a vehicle. The patient achieves mental stimulation from the awareness he obtains from his own ability to render control over the vehicle. By providing an operator-controlled water vehicle which exposes portions of the user's body to the water, applicant has found that it is possible to achieve both mental and physical stimulation of the patient.

Water vehicles of the type adapted for a single user have been previously known in the art. Applicant is aware of the teachings of U.S. Pat. Nos. 2,752,617; 3,177,327; and 4,115,888. However, the buoyant chairs of these patents are not intended for therapeutic purposes and fail to provide the physical stimulus desired for therapeutically aiding the handicapped person. These devices could be unstable and, if the same were to be used by one with a physical disability, would pose a dangerous instrumentality, if not properly constructed.

DISCLOSURE OF INVENTION

In light of the foregoing, it is an object of the instant invention to provide a propelled pontoon chair capable of exposing the user's lower extremities to the water upon which the chair is caused to move.

Another object of the invention is to provide a propelled pontoon chair which allows the operator to control the movement of the same through the water.

An additional object of the invention is to provide a propelled pontoon chair which is of stable construction, safely securing the user in a partially immersed state, while protecting the user from the dangers of the water.

Yet a further object of the invention is to provide a propelled pontoon chair which is durable and reliable in operation, simple and inexpensive to construct, and readily adapted for obtaining beneficial physical and psychological effects on the user.

The foregoing and other objects of the invention which will become apparent as the detailed description proceeds are achieved by a water vehicle, comprising: a pair of pontoons: a support member maintained between said pontoons: and a chair adjustably positioned upon said support member.

Other objects of the invention are achieved by a water vehicle, comprising: a pair of pontoons spaced apart from each other: a vertically adjustable chair positioned between said pontoons; propulsion means maintained behind said chair; and control means connected to said propulsion means for regulating both speed and direction of movement of the vehicle.

BRIEF DESCRIPTION OF DRAWINGS

For a complete understanding of the objects, techniques, and structure of the invention, reference should be had to the following detailed description and accompanying drawings wherein.

BEST MODE FOR CARRYING OUT THE INVENTION

Figure 1:
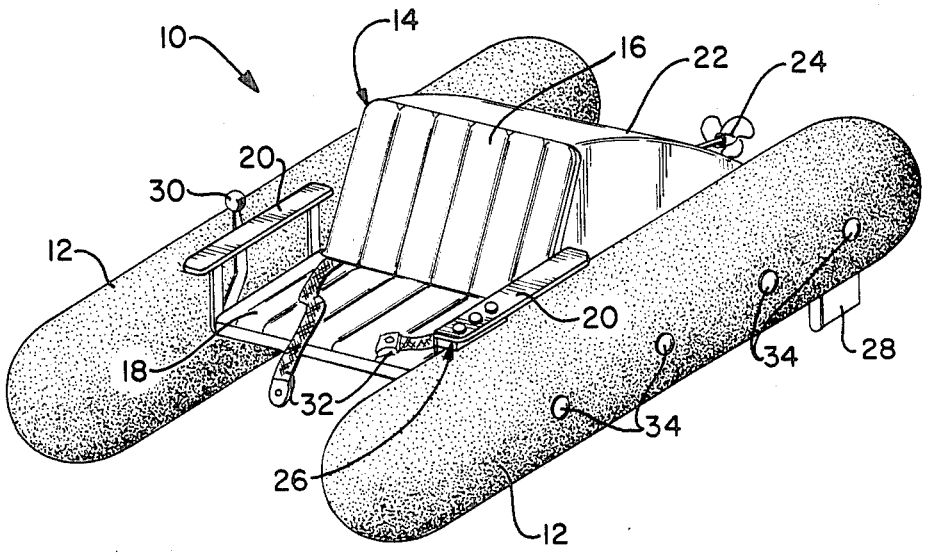
FIG. 1 is a perspective view of the propelled pontoon chair of the invention.

Referring now to the drawings and more particularly FIG. 1, it can be seen that a propelled pontoon chair made in accordance with the invention is designated generally by the numeral 10. A pair of pontoons 12 is interconnected in fixed spaced relationship to each other and maintains therebetween a chair 14. This chair may be supported on a frame interconnecting the pontoons. It will be appreciated that the pontoons 12 are provided for buoyancy and, to that end, may be constructed of Styrofoam. To prevent the Styrofoam from becoming saturated with water, the pontoons 12 may be sealed with a silicon coating, or appropriately covered with a light vinyl or Visqueen material or water-base acrylic polymer paint. Solid pontoon construction is preferred over that of inflatable pontoons for obvious safety reasons. Additionally, it is preferred that the pontoons be of such size and character that they will not submerge more than half of their depth into the water, guaranteeing stability and flotation.

The chair 14 includes an adjustable back 16 and a seat 18, both being preferably cushioned. With the back 16 being adjustable as to its angle with the seat 18, various positions of the patient or other user of the device 10 may be obtained. The chair 14 also includes arms 20 on each side of the seat 18 for purposes of supporting and maintaining the user.

A flexible cover 22 interconnects the seat back 16 and the frame interconnecting the pontoons 12 as shown. The cover 22 is preferably of the accordion type, having a plurality of collapsible ribs for achieving the desired structure. The accordion nature of the cover 22 accommodates the adjustability of the seat back 16. The purpose of the cover 22 is to shield or seal the propulsion power source of the assembly 10 from the water upon which the assembly is to be maintained. Both the driver motor and the power source for the same may be maintained within this cover 22, such motor driving a propeller 24 in standard water-engaging fashion. For safety purposes, it is preferred that the propeller 24 be of a soft, pliable, plastic construction, sufficient to achieve propulsion within the water, and yet soft enough to eliminate the possibility of physical harm. The rotational speed of the propeller 24 may be controlled by an appropriate control box 26 maintained on one of the arms 20. As will be appreciated hereafter, the control box 26 may include a plurality of pushbuttons, or a slide lever, to allow the operator to select the propeller speed and, accordingly, the rate of travel of the pontoon chair 10.

At the end of each of the pontoons 12 is a rudder 28. As will be elaborated upon hereafter, the rudders 28 are controlled via a rudder control stick 30 handily positioned in juxtaposition to one of the arms 20. The control box 26 and control stick 30 afford the user complete control of the pontoon chair 10 at the user's fingertips. Finally, seat belts 32 are provided in association with the chair 14 and in preferable interconnection with the frame of the assembly 10 to assure maintenance of the user in a proper and safe position.

Figure 2:
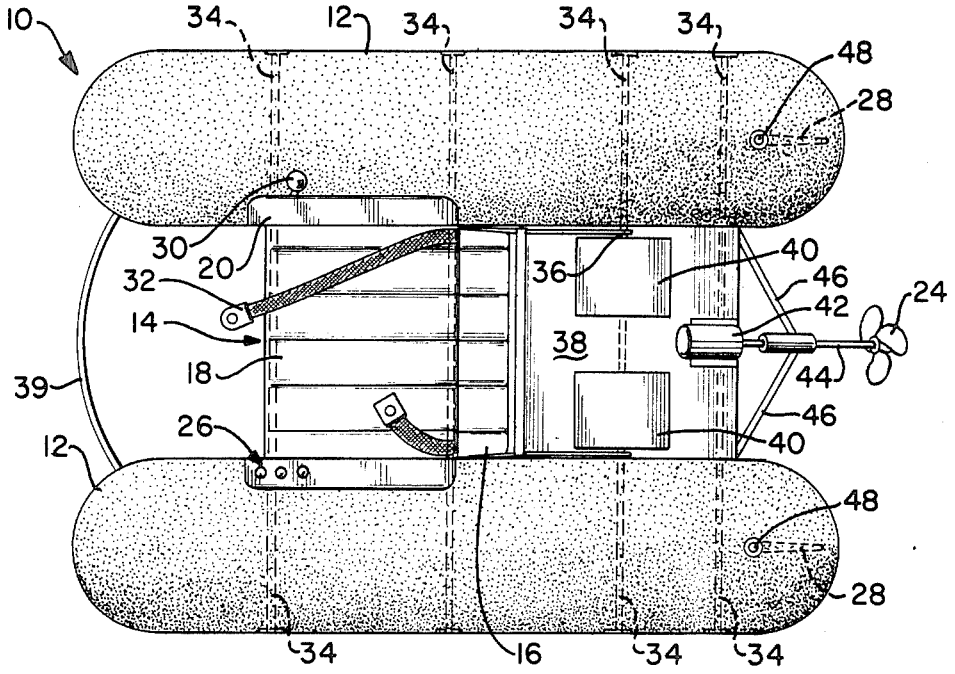
FIG. 2 is a top plan view of the propelled pontoon chair of the invention.

With reference now to FIG. 2, it can be seen that the pontoons 12 are maintained in their fixed relationship by a plurality of rods 34 passing therebetween. The rods 34 each have a head at one end thereof and are threaded at the other to receive a nut. The heads and nuts are preferably maintained in recessed areas of the pontoons 12 so as not to provide a dangerous protrusion. Each of the rods 34 passes through a sleeve or spacer 36 which is maintained between the pontoons 12 to obtain the desired fixed spaced relationship thereof. The sleeves 36 are of larger diameter than the bores in the pontoons 12 which receive the rods 34. In a preferred embodiment of the invention, a base or frame board 38 is provided atop the spacers 36 for receiving thereon the chair 14 and the propulsion means to be described hereinafter. The front edge of the seat 18 is spaced rearwardly from the front edge of the pontoons 12 a distance of approximately 18 inches for protection of the user's knees. A plastic mesh or knee guard 39 may be provided for additional protection if desired.

As is further shown in FIG. 2, a pair of batteries 40 may be maintained on the frame 38 and in selective interconnection with the DC motor 42. This selective interconnection may be achieved via the control box 26 described above. In any event, the DC motor 42 is connected to a propeller shaft 44 for driving the propeller 24. As shown, a pair of braces 46 are attached to a sleeve for receiving the shaft 44, in somewhat standard fashion. The braces 46 are preferably interconnected in some manner to the base or frame 38.

It will be appreciated that if the motor 42 is a DC motor and the batteries 40 are of equal size, the control box 26 may be used to interconnect the batteries 40 with the motor 42 in either parallel or series connection. In such manner, the voltage applied to the motor 42 is either halved or doubled, thereby regulating the propulsion speed of the pontoon chair 10.

Figure 3:
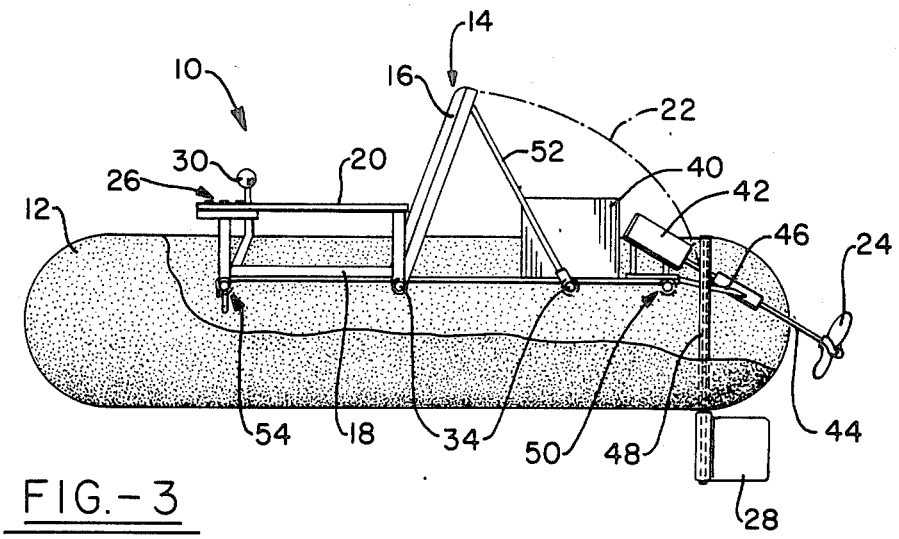
FIG. 3 is a side elevational view of the propelled pontoon chair of the invention.

With reference to FIGS. 2 and 3, it can be seen that the rudders 28 are connected to appropriate rudder shafts 48 passing through the rearward ends of the pontoons 12. The shafts 48 are operative in a manner to be discussed hereinafter to control the rudders 28 in tandem to achieve the desired navigation of the assembly 10. It will also be noted from FIG. 3 that the motor 42 and propeller shaft 44 may be hingedly connected to the frame 38 for safety purposes, allowing the motor and propeller to swing upwardly when an obstruction is contacted. It will also be noted from FIG. 3 that the seat back 16 has connected thereto an adjustable support rod 52 for achieving the desired changes in inclination of the back 16. Finally, this figure illustratively shows the rudder control linkage 54 discussed directly below.

Figure 4:
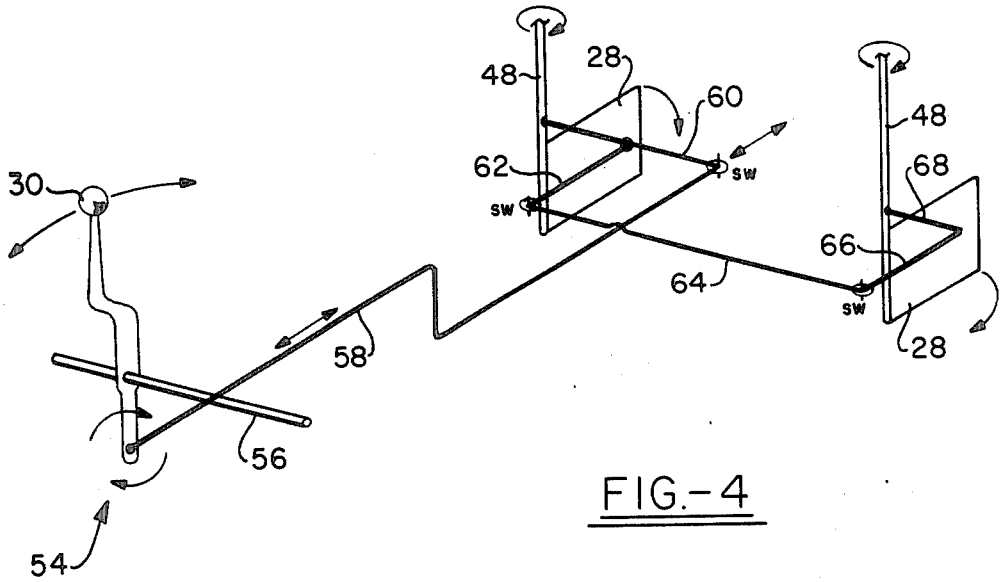
FIG. 4 is a pictorial illustration of the rudder assembly used in conjunction with the propelled pontoon chair of the invention.

As shown in FIG. 4, the rudder control stick 30 is interconnected with the linkage 54 as at a pivot rod 56. It will be appreciated that the rod 56 could, indeed, be one of the connection rods 34 discussed hereinabove. In any event, the engagement between the stock 30 and the rod 56 is a frictional one, achieving a frictional locking at any position selected by the operator until moved from that position. The end of the stick 30 is connected to a drive linkage or rod 58 which is then connected by a swivel connection to a connecting rod 60 for direct interconnection with one of the rudders 28. Fixedly connected to the connecting rod 60 is the rod 62. Similarly, a connecting rod 68 is provided in fixed interconnection with the other rudder 28 and has fixedly extending therefrom a connecting rod 66. The connecting rods 62,66 communicate with each other and operate in tandem by swivel connections to a common connecting rod 64. In operation, movement of the stick 30 causes a corresponding movement of the rod 58 which then achieves tandem movement of the rudder assemblies 28 by means of the rod linkages 60–68.

In use, an operator may sit within the chair 14, having the back 16 positioned at any desired comfortable position. The seat belt 32 is then used to safely secure the user within the chair. At the operator's fingertips are a control box 26 for regulating the speed and direction of the rotation of the propeller 24, and a rudder control stick 30 for steering the device 10. The operator thus has complete control over the pontoon chair 10 achieving the mental benefit of such control. As the chair 10 moves through the water, the user's legs dangle in the water and achieve the benefit of the stimulation of the water passing thereacross. Additionally, when used in the outdoors, the user achieves the benefit of sunlight and fresh air.

In its preferred embodiment, the seat 18 of the chair 14 is maintained two to four inches above the centerline of the pontoons 12, with the waterline preferably being at such centerline when in use. Further, the positioning of the batteries 40 rearwardly of the assembly 10 and the user forwardly thereof, and with the assembly 10 being symmetric about a line drawn between the pontoons 12, the center of gravity of the assembly 10 closely approximately the geometric center of the assembly, providing for an extremely stable device.

It will be appreciated by those skilled in the art that the invention is preferably constructed of non-corrosive elements, such as rubber, plastic, aluminum, and the like. It will further be appreciated that certain modifications and substitutions may be made in the structure of the invention. For example, it is presently contemplated that the DC motor 42 could, indeed, be an air motor, with the batteries 40 being replaced by an air cylinder. Such a change, as well as those which will become apparent to those skilled in the art, is contemplated as comprising a portion of the invention.

Figure 5:
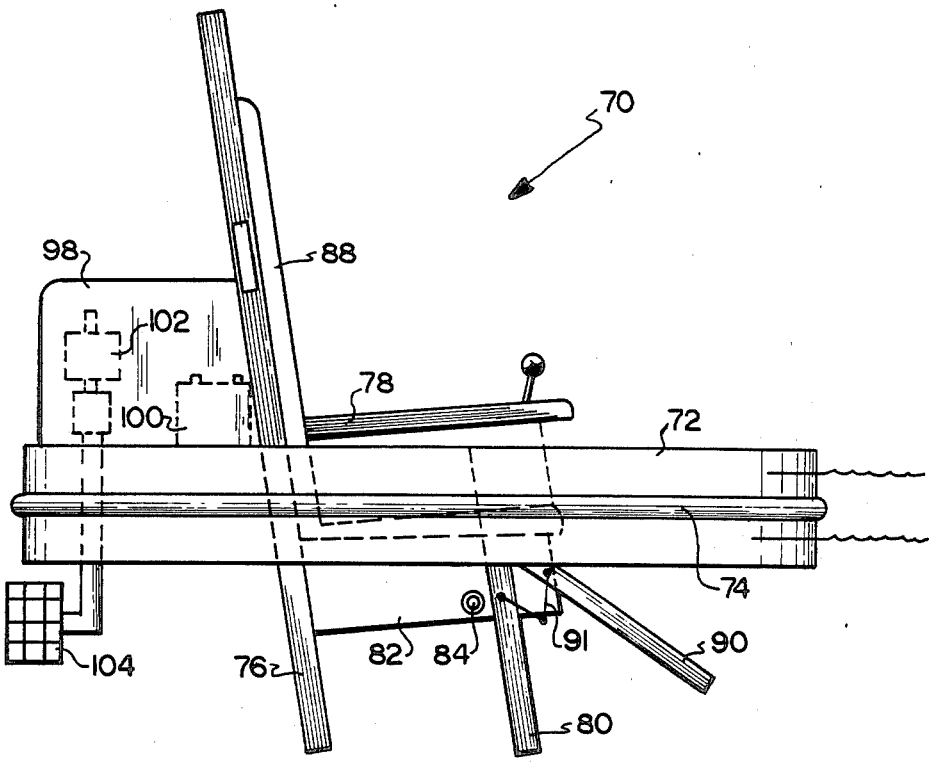
FIG. 5 is a side perspective view of a second embodiment of the invention.
Figure 6:
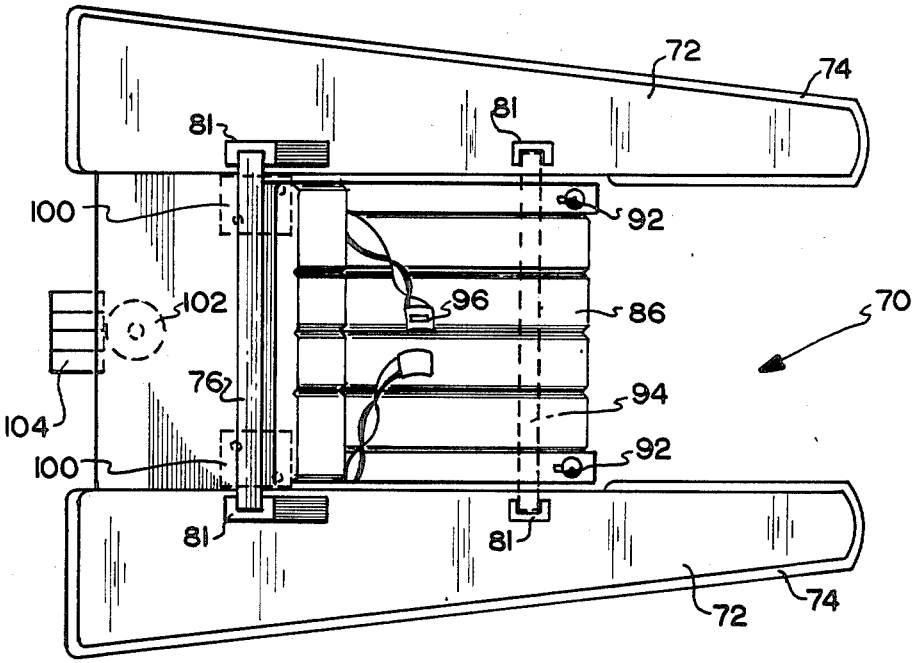
FIG. 6 is a top plan view of the embodiment of FIG. 5.

With continued reference to the drawings, and more particularly FIG. 5 and 6, yet another embodiment of the invention can be seen. In this case, the propelled pontoon chair of the invention is designated generally by the numeral 70. As shown, the pontoon chair 70 includes a pair of uniformly spaced pontoons 72 which are of a trapezoidal geometric configuration. The outer surfaces of the pontoons are angled inwardly as shown to achieve a degree of stability in operation. Further, the streamlined design of the pontoons 72 achieves laminar waterflow, greatly reducing the restrictive forces imparted upon the assembly 70 by the water. For purposes of safety, resilient bumpers 74 are provided about the exterior surfaces of the pontoons 72. In a preferred embodiment, the bumpers are of rubber construction. However, bumpers utilizing hydraulic, pneumatic, or spring biased shock absorbing devices could also be used.

A U-shaped chair support member 76 is maintained between the pontoons 72. As illustrated, the chair support 76 is angled rearwardly for purposes of safety and comfort of the user. A chair 78 is adjustably maintained upon the support 76 and between the front chair support rails 80. The adjustability of the chair itself will become apparent hereinafter with respect to FIGS. 11 and 12. It should also be appreciated that the front chair support rails 80 are, as in the case of the chair support 76, fitted into a containing channel 81 within each pontoon 72 to provide support for the chair assembly as it is raised or lowered.

A ballast tank 82 is provided with a plug 84 to allow for the entry or exit of water or other fluid for purposes of adjusting the flotation level of the pontoon chair 70 when occupied by users of various weights. This ballast tank 82 is preferably affixed to the seat 86 of the chair. It will also be appreciated that other selectively variable ballast means may be employed. The invention also contemplates the use of solid ballast such as lead weights or the like which may be selectively placed into or retrieved from the tank or ballast compartment 82 by means of a hinged door or other access means. Of course, the chair also includes a chair back 88 which is appropriately maintained in fixed positional relationship with respect to the seat 86.

An adjustable leg rest 90 is connected by means of a frictionally locking hinge 91. This allows the user to position his legs in a manner most comfortable or therapeutically beneficial to him. Preferably, the leg rest 90 is longer than the user's shin length such that the perimeter of the leg rest 90 encompasses the user's legs and feet and protects them from obstructions in the water. The hinge 91 allows the leg rest 90 to be positioned through an arc of approximately 90°, allowing the user to freely swing his feet if so desired.

As further shown in the drawings, control levers 92 may be positioned on either side of the seat 86, in a manner to be discussed hereinafter, to accommodate either righthanded or lefthanded individuals. Further, if the user needs to exercise one arm or the other, the control levers may be positioned on that side. These control levers are functional to regulate the speed and direction of the pontoon chair 70.

As best shown in FIG. 6, a brace 94 interconnects the front chair support rails 80 for purposes of stability. As is further shown in FIG. 6, for purposes of safety, a seat belt 96 is preferably included in association with the seat 86.

A rear compartment 98 is maintained behind the U-shaped chair support frame 76. The compartment 98 houses a pair of batteries 100 which are interconnected to an electric motor 102 for purposes of driving the same. In a preferred embodiment of the invention, the electric motor is trolling motor which is bearing mounted so that it may be easily rotated to control direction as will be discussed hereinafter. A caged propeller 104 is driven by the motor 102, the cage providing protection to the user and others who might be in the water. The invention also contemplates the use of other propulsion devices. For example, a compressed air motor, a water jet, or any of numerous propeller drive mechanisms may be employed to achieve the beneficial results of movement through or across the water.

Figure 7:
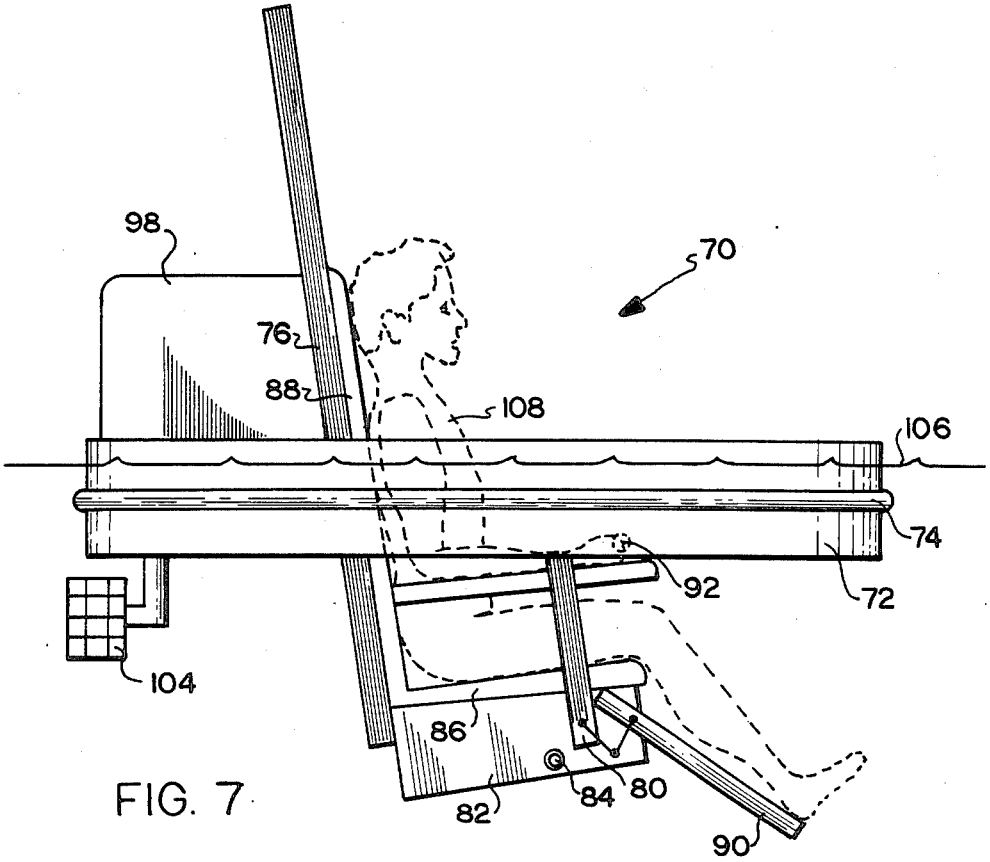
FIG. 7 is a side perspective view of the second embodiment of the invention showing an operator therein.

FIG. 7 shows the propelled pontoon chair 70 of the invention as the same would be utilized by an individual desiring to either enjoy himself or obtain the therapeutic benefits of water movement. It will be noted that the chair comprising the seat 86 and back 88 has been lowered with respect to the frame 76 such that the occupant 108 rides with his mid torso at the water level 106. Of course, any suitable adjustment could be made. It will be appreciated that the water level 106 is determined by the relative buoyancy of the pontoons 72 when taken in consideration with the load being carried. This water level 106 is readily adjusted by means of increasing or decreasing the ballast maintained within the ballast tank or compartment 82 via the plug 84.

Figure 8:
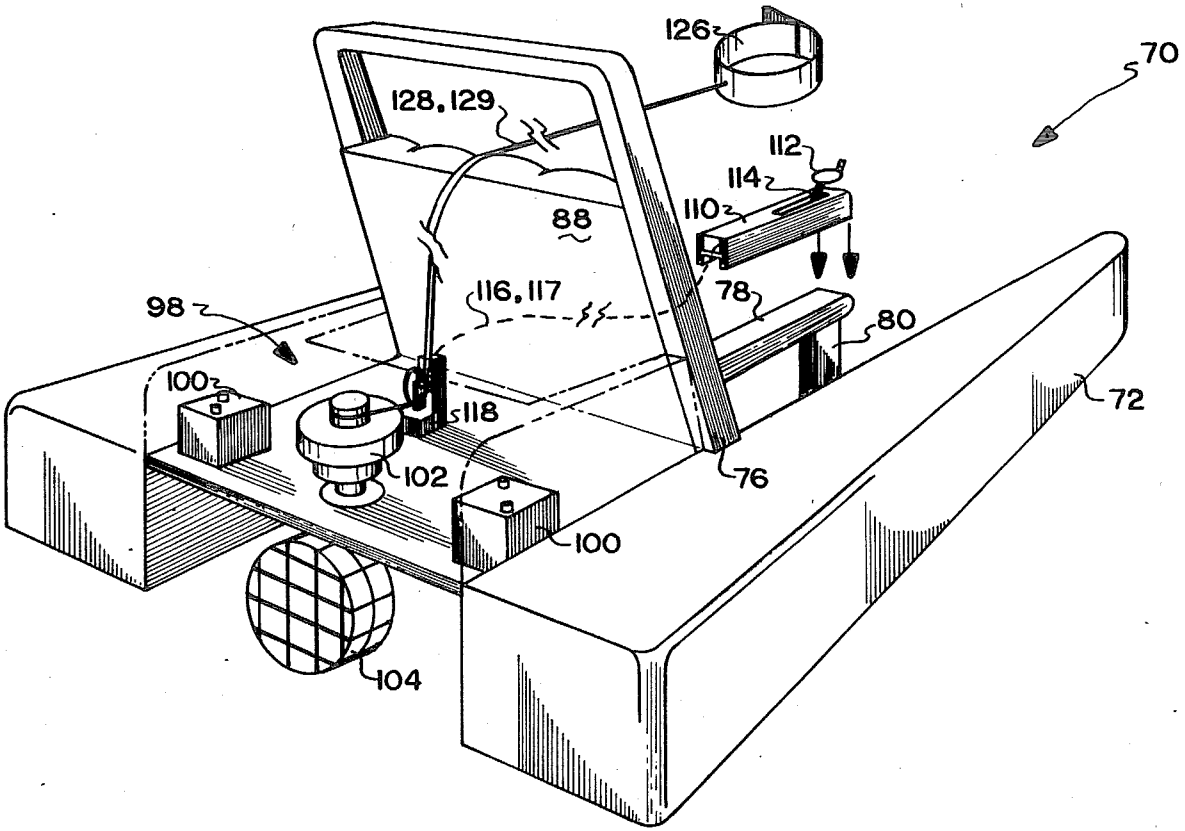
FIG. 8 is a rear elevational view of the embodiment of the invention of FIG. 5.

With reference now to FIG. 8, a schematically illustrative view of the pontoon chair 70 can be seen. Here, it will be noted that the pontoons 72 are shown without the bumpers 74, and that other portions are only illustratively demonstrated. However, from this view, taken in conjunction with the illustrations of FIGS. 9 and 10, an appreciation of the control mechanism of this embodiment of the invention can be seen. As shown, an arm rest control assembly 110 is received over an arm rest of the chair 78. This arm rest control assembly can be placed over the right arm or the left arm, depending upon which arm the user desires to exercise, or which arm is most comfortable for use. The control assembly 110 includes a dial 112 which may be rotated by the user and held at any preselected position to select a desired speed for movement of the pontoon chair 70. In like manner, the lever 114, to which the dial 112 is connected, may be moved forwardly or rearwardly to control the direction of movement of the pontoon chair 70. The dial 112 and the control lever 114 are connected to the speed and direction control cord 116 as shown.

Figure 9:
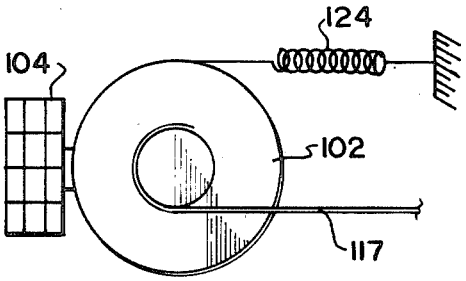
FIG. 9 is a top plan view of the motor drive and direction control mechanism of the invention.
Figure 10:
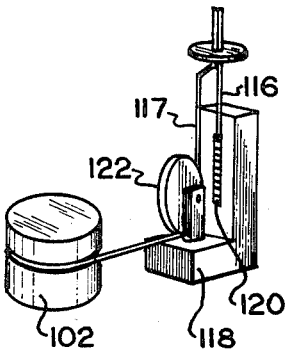
FIG. 10 is an illustrative view of the speed and direction control structure of the invention.

With reference to FIGS. 9 and 10, it can be seen that a block 118, maintained within the rear compartment 98, maintains thereon a linear or rotary rheostat 120 which is spring loaded such as to have a normally biased high resistance characteristic. The control wire 116 connects to the rheostat 120 and to the dial 112 such that turning of the dial 112 adjusts the rheostat 120. With the rheostat 120 interposed between the batteries 100 and the motor 102, control of the speed of the pontoon chair 70 is achieved. It will be appreciated that, by providing the rheostat 120 as spring biased, should the operator release the dial 112, the rheostat will achieve a high resistance level, greatly reducing the speed of the motor 102, if not stopping it altogether. Accordingly, should the operator lose control of the dial 112, this safety feature provides that the unit will come to a stop.

It is also contemplated that a switch may be provided on the control assembly 110 to regulate the rotational direction of the motor 102, achieving forward or reverse movement of the propelled pontoon chair 70. Such switch control, reversing current flow in the motor 102, is readily appreciated by those skilled in the art.

It will also be noted that a control wire 117 interconnects the motor 102 to the lever 114 through a pulley wheel 122 connected to the block 118. Movement of the lever 114 therefore controls rotation of the motor 102 to direct the caged propeller 104. As best shown in FIG. 9, the motor 102 is biased by the spring 124 into a normal position which would cause the pontoon chair 70 to turn in a counterclockwise position. Movement of the lever 114 is against the force of the spring 124, exercising the arm of the user. In the event the user should lose control of the lever 114, the spring 124 will move the motor 102 into a position that the caged propeller 104 will cause the pontoon chair 70 to begin movement in a counterclockwise circle. This safety factor prevents the user from either going too far adrift, or from bumping into other objects in the event that lever control is lost.

With reference again to FIG. 8, it can be seen that a portion of the invention is the utilization of a headband 126 to achieve the control functions just discussed. In this embodiment, the headband 126 includes mating hook and loop materials to provide an adjustability feature. Connected to the headband 126 is a control cable 129 such that rotation of the operator's head will control the direction of the motor 102 in the manner just discussed above. Also connected to the headband 126 is a cable 129 such that movement forward or backward of the operator's head will control the rheostat and thus the speed in the manner just discussed above. Accordingly, an operator who has no use of either hand may control the pontoon chair 70 by head movements.

Figure 13:
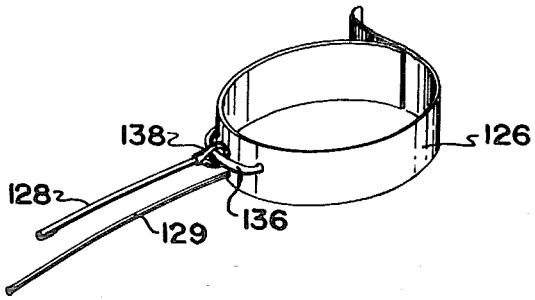
FIG. 13 is a headband having speed and directional control cables attached thereto.

As best shown in FIG. 13, the headband 126 may be provided with a bracket 136 affixed at the back thereof for receiving a ring 138 which is attached to the control cable 128. Accordingly, rotation of the user's head will not affect speed because the ring 138 freely slides upon the bracket 136 during such rotation. Only tilting of the user's head will effect speed. In like manner, the control cable 129 is fixedly attached directly to the headband 126 such that rotation of the head directly affects direction. While tilting of the head to affect speed will, to some degree, alter direction, the user may compensate by rotating his head, achieving further therapeutic benefits.

It will be appreciated by those skilled in the art that the cables 116, 117, 128, 129 may be of any desired construction. It has been found that common marine cord is suitable to achieve the control functions just described. Alternatively, sheathed control wires may be used.

Figure 12:
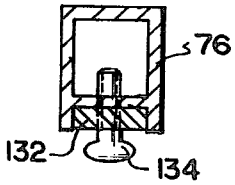
FIG. 12 is a sectional view of the chair support channel and adjustment mechanism of the invention.
Figure 11:
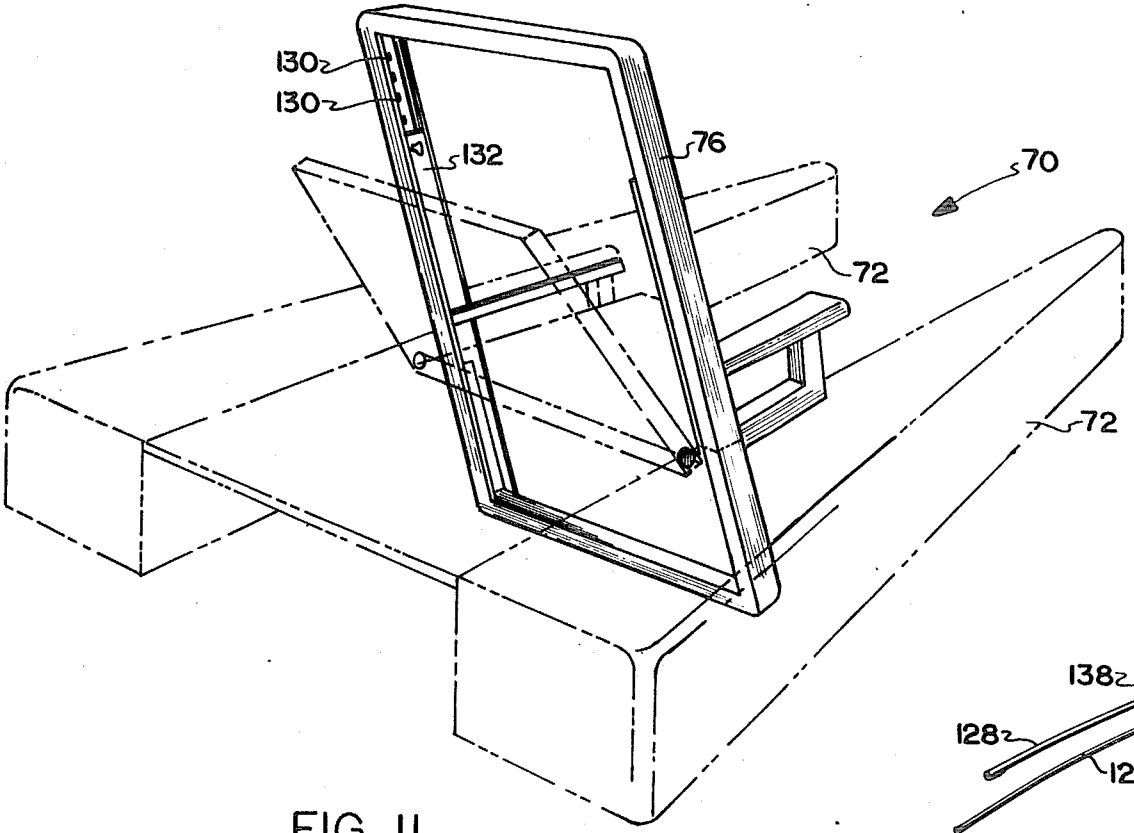
FIG. 11 is an illustrative view of the embodiment of FIG. 5 showing the adjustable seat.

With reference now to FIGS. 11 and 12, the adjustability feature of the chair of the invention can be had. A particular benefit of the instant invention is that the user may position himself at various depths in the water to achieve the therapeutic benefit of water passing over various parts of bis body. To this end, the chair support frame 76 is provided of channel construction. A plurality of holes 130 extend along each of the vertical side members of the support frame 76. Vertical side members 132 are connected to the chair back 88 and are received in the channel of the chair support member 76. These vertical side members each have a hole therein to be aligned with one of the holes 130 at the desired position of the seat 88. When the holes are so aligned, as shown in FIG. 12, a pin, bolt, or the like 134 may be used to interengage the two holes and to maintain the chair in the selected position.

Thus it can be seen that the objects of the invention have been satisfied by the structure presented hereinabove. While in accordance with the patent statutes only the best mode and preferred embodiment of the invention has been presented and described in detail, it is to be understood that the invention is not limited thereto or thereby. Accordingly, for an appreciation of the true scope and breadth of the invention, reference should be had to the following claims.

What is claimed is:

1. A water vehicle, comprising:

a pair of spaced apart pontoons;

a support means maintained between said pontoons;

a chair adjustably positioned upon said support means;

propulsion means for moving the vehicle through the water, said propulsion means positioned behind said chair; and operator control means for regulating both speed and direction of the vehicle, said control means including a pair of cables, a first cable connected to said propulsion means for controlling direction, a second cable connected to a regulator for controlling speed, and a headband having a bracket attached thereto, said first cable being connected directly to said headband and said second cable being slidably received upon said bracket.

2. A water vehicle, comprising:

a pair of pontoons spaced from each other;

a vertically adjustable chair positioned between said pontoons;

propulsion means maintained behind said chair; and control means connected to said propulsion means for regulating both speed and direction of movement of the vehicle, said control means comprising a headband fixedly secured to a first cable and slidingly secured to a second cable, said first and second cables respectively controlling direction and speed of the vehicle.

3. The water vehicle according to claim 2 wherein said propulsion means comprises a pivotally mounted motor which is spring biased to a first position.

4. The water vehicle according to claim 3 wherein said control means comprises a first cable connected to said motor for controlling direction of the vehicle and a second cable connected to a rheostat for controlling the speed of the vehicle.

5. The water vehicle according to claim 2 wherein said pontoons are of trapezoidal configuration.

6. A water vehicle, comprising:

a pair of spaced apart pontoons;

a support member maintained between said pontoons;

a chair vertically adjustably positioned upon said support member;

means for varying ballast maintained directly beneath said chair and comprising a compartment selectively sealed by a plug, said ballast varying as a function of an amount of liquid within said compartment, said liquid entering and exiting via said plug; and wherein the space between said pontoons in front of said chair is open, allowing the legs of a user within said chair to extend downwardly between and beyond said pontoons for entry into the water.

7. The water vehicle as recited in claim 6 wherein said chair includes an adjustable leg rest.

8. The water vehicle as recited in claim 6 which further includes propulsion means for moving the vehicle through the water, said propulsion means positioned behind said chair.

9. The water vehicle as recited in claim 8 which further includes operator control means for regulating both speed and direction of the vehicle.

10. The water vehicle as recited in claim 9 wherein said control means includes a pair of cables, a first cable connected to said propulsion means for controlling direction, and a second cable connected to a regulator for controlling speed.

11. The water vehicle as recited in claim 10 wherein said regulator comprises a rheostat.

12. The water vehicle as recited in claim 11 wherein said propulsion means comprises an electric motor, said electric motor being pivotally mounted and biased to a first position.

13. The water vehicle as recited in claim 12 where said motor is biased by a spring.

14. The water vehicle as recited in claim 10 wherein said control means is maintained on an arm of said chair.

15. The water vehicle as recited in claim 14 wherein said control means comprises a panel having a level and a dial, said level connected to aid first cable and said dial connected to said second cable.

* * * * *